US008499911B2

(12) United States Patent
Ichimura

(10) Patent No.: US 8,499,911 B2
(45) Date of Patent: Aug. 6, 2013

(54) POWER SUPPLY SYSTEM FOR CRANE

(75) Inventor: Kinya Ichimura, Oita (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 118 days.

(21) Appl. No.: 13/254,352

(22) PCT Filed: Mar. 5, 2010

(86) PCT No.: PCT/JP2010/053657

§ 371 (c)(1),
(2), (4) Date: Oct. 6, 2011

(87) PCT Pub. No.: WO2010/101244

PCT Pub. Date: Sep. 10, 2010

(65) Prior Publication Data

US 2012/0043291 A1 Feb. 23, 2012

(30) Foreign Application Priority Data

Mar. 5, 2009 (JP) ..... 2009-052185

(51) Int. Cl.
*B66C 13/12* (2006.01)

(52) U.S. Cl.
USPC ..... 191/12 R; 191/12.2 R

(58) Field of Classification Search
USPC ..... 191/12 R, 12.2 R, 12 C; 248/49, 248/317; 212/312
See application file for complete search history.

(56) References Cited

U.S. PATENT DOCUMENTS 3,940,577 A * 2/1976 Christofer ..... 191/12 R
5,511,268 A * 4/1996 Albus et al. ..... 14/77.1
5,788,033 A * 8/1998 Lucking et al. ..... 191/33 R
6,920,963 B2 * 7/2005 Faller ..... 187/406
7,554,278 B2 * 6/2009 Wegner-Donnelly et al. ..... 318/375
7,967,120 B2 * 6/2011 Popesco ..... 191/12.2 R
8,061,495 B2 * 11/2011 Ichimura ..... 191/33 R (Continued)

FOREIGN PATENT DOCUMENTS

JP 62-295815 A 12/1987
JP 2003-160295 A 6/2003
JP 2007-223805 A 9/2007
WO 2009-002509 A1 12/2008

*Primary Examiner* — Jason C Smith
(74) *Attorney, Agent, or Firm* — Jacobson Holman PLLC

(57) ABSTRACT

Provided is a power supply system including a crane and a power supply truck. In the power supply system, a linkage mechanism efficiently transmits a force in a travel direction x to the power supply truck, while not transmitting any force in a transverse direction y or a twisting direction, and has a highly durable configuration. In a power supply system 1 for a crane in which a crane 2 for loading and unloading a container for marine transportation is linked to a power supply truck 3 for supplying power while following the crane 2, with a linkage mechanism 4, the linkage mechanism 4 includes a receiving member 10 disposed on the power supply truck 3, and a pushing member 11 disposed on the crane 2. The power supply system 1 includes the linkage mechanism 4 configured in a manner that, when the crane 2 moves in a travel direction x, the pushing member 11 comes into contact with the receiving member 10, to transmit a force of the crane 2 moving in the travel direction x to the power supply truck 3, and when the crane 2 moves in a transverse direction y intersecting the travel direction x, the receiving member 10 does not disturb move of the pushing member 11 and a force of the crane 2 moving in the transverse direction y is not transmitted to the power supply truck 3.

5 Claims, 4 Drawing Sheets

U.S. PATENT DOCUMENTS

2007/0251784 A1* 11/2007 Popesco ..... 191/12.2 A
2009/0127048 A1* 5/2009 Ichimura ..... 191/33 R
2012/0043291 A1* 2/2012 Ichimura ..... 212/312
2012/0193315 A1* 8/2012 Noll ..... 212/312

* cited by examiner

POWER SUPPLY SYSTEM FOR CRANE

CROSS-REFERENCE TO RELATED APPLICATIONS

The present patent application is a nationalization of International application No. PCT/JP2010/053657, filed Mar. 5, 2010, published in Japanese, which is based on, and claims priority from, Japanese Application No. 2009-052185, filed Mar. 5, 2009, both of which are incorporated herein by reference in their entireties.

TECHNICAL FIELD

The present invention relates to a power supply system for a gantry crane used for loading and unloading containers at a harbor or inland container terminal, or the like.

BACKGROUND ART

At a container terminal in a harbor, an inland area or the like, quay cranes and gantry cranes are used to load and unload containers to and from ships and trailers.

FIG. 6 is a schematic view of a harbor container terminal 30. A container 35 on a container ship 34 is loaded onto a trailer 33 by a quay crane 36, and is then loaded onto a lane 31, which is a container load block, from the trailer 33 by a gantry crane 2X. In some cases, the container 35 is transported to the destination of the load while being kept on the trailer 33.

Here, the gantry cranes 2X may be classified broadly into a rail-mounted type and a rubber-tire type. A rail-mounted gantry crane (referred to as an RMT below) moves on rails laid along the lane 31 at approximately eight km per hour to perform loading and unloading operations. Electricity to serve as power for the RMT is often supplied by connecting a cable, installed in the crane 2X, to a power supply connector 32 in the terminal.

By contrast, a rubber-tired gantry crane (referred to as an RTT below) travels on tires. Having this configuration, the RTT can easily move between lanes (change lanes), and can hence be moved easily to the lane 31 that is assigned to a lot of loading and unloading operations. To make use of the maneuverability of the RTT, power for the RTT is often electricity supplied by a diesel generator or the like provided in the RTT.

In these years, out of consideration for environment, energy sources for RTTs are increasingly switched from power generated by diesel generators, which produce exhaust gas, to shore electricity supplied from the container terminal 30 (see Patent Document 1, for example). Patent Document 1 discloses a method of supplying power to an RTT by using a cable reel, which is means for reeling and unreeling a cable, as in the case of an RMT. Using this method can reduce exhaust gas. However, although one of the advantages of RTTs is to be capable of changing lanes easily, this is difficult in the case of using the above-described method. Specifically, an on-shore power supply connector 32 connected with the cable reel is provided for each lane, and for changing lanes, the cable needs to be detached from and attached to the power supply connectors 32 of the lanes. Moreover, the power supply connectors 32 carry high-voltage electricity and have problems in safety and operability in attaching and detaching operations. To solve these problems, a power supply system has been proposed in which a power supply truck is linked to a crane to supply power to the crane through the power supply truck (see Patent Document 2, for example).

As shown in FIG. 7, a power supply system 1X described in Patent Document 2 includes a power supply truck 3X in which a cable reel and a transformer are installed. The power supply system 1X is configured to supply power to the crane 2X by converting high-voltage electricity transmitted by an on-shore power supply to low-voltage electricity by using the transformer. A cable is attached or detached for a lane change at a connection part 21 between the transformer and the crane. Since low-voltage current obtained from the conversion by the transformer flows through the connection part 21, this configuration can improve safety and operability in attaching and detaching the cable for lane changes, to some extent. Incidentally, the high-voltage electricity is defined to be in the range of 3300 to 11000 V, and the low-voltage electricity, although varying depending on country and area, is defined to be 600 V or below in Japan, for example.

In addition, the power supply truck 3X has a configuration of being towed by the crane 2X by use of a linkage mechanism 4X linking the crane 2X and the power supply truck 3X, and travels on a power-supply-truck traveling rail 23 laid on a lane 31, by following the crane 2X. Incidentally, the power supply truck 3X is self-propelled by including therein a driving system in some cases, but often has a configuration of being linked to the crane 2X with the linkage mechanism 4X and towed by the crane 2X in consideration of the cost.

Here, the linkage mechanism 4X needs to be a flexible linkage structure 4X in such a manner that vibrations and the like caused along with travel of the crane 2X would not affect the power supply truck 3X. For this purpose, a universal joint, a link mechanism or the like is used for the linkage mechanism 4X (see FIG. 3 and FIG. 5 in Patent Document 2, for example).

PRIOR ART DOCUMENTS

Patent Documents

Patent Document 1: Japanese Patent Application Kokai Publication No. 2007-223805

Patent Document 2: International Patent Application Publication No. WO2009/002509

SUMMARY OF THE INVENTION

Problems to be Solved by the Invention

However, a universal joint has a problem of transmitting a force generated in a transverse direction or a twisting direction to the power supply truck 3X and causing a derailment accident or the like of the power supply truck 3X. Specifically, if the crane 2X is shifted in a transverse direction y as shown in FIG. 8B, the power supply truck 3X receives a force in the transverse direction y from the crane 2X, and consequently derails from the rail 23. This may lead to an accident in which the power supply truck 3X overturns, in some situations. Moreover, a case in which the crane 2X is shifted in a twisting direction relative to a travel direction x as shown in FIG. 8C also has a risk of a derailment and turnover accident as in the above case. Especially, the RTT (rubber-tired gantry crane) has a travel deviation of approximately ±150 mm in a transverse direction and an angle deviation of approximately ±2° in a twisting direction and hence has a problem that large forces are transmitted to the power supply truck 3X. Further, since the RTT has a configuration in which a crane is supported by rubber tires, the RTT is displaced by approximately 150 mm in a vertical direction due to the weight of the load being lifted. Incidentally, FIG. 8A shows, for comparison, a state in which the crane 2X travels straight in the travel direction.

In addition, the linkage mechanism 4X is exposed to sea breeze as well as wind and rain, and is hence required to be highly durable and have a simple mechanism. For example, in the case of using a link mechanism or a universal joint, a moving part rusts, so that vibrations and travel deviation of the crane 2X cannot be absorbed.

The present invention has been made to solve the above-described problems, and aims to provide a power supply system, including a crane and a power supply truck, in which a linkage mechanism is configured to efficiently transmit a force in a travel direction x to the power supply truck while not transmitting any force in a transverse direction y or a twisting direction and has a highly-durable configuration. Further, the present invention aims to provide a power supply system capable of changing lanes easily.

Means for Solving the Problems

In a power supply system for a crane according to the present invention for achieving the above-described objects, a crane for loading and unloading a container for marine transportation is linked to a power supply truck for supplying power while following the crane, with a linkage mechanism. The power supply system is characterized in that the linkage mechanism includes a receiving member disposed on the power supply truck and a pushing member disposed on the crane, and that the power supply system includes the linkage mechanism configured in a manner that, when the crane moves in a travel direction, the pushing member comes into contact with the receiving member, to transmit a force of the crane moving in the travel direction to the power supply truck, when the crane moves in a transverse direction intersecting the travel direction, the receiving member does not disturb move of the pushing member and a force of the crane moving in the transverse direction is not transmitted to the power supply truck, and when the crane is displaced in a vertical direction, the receiving member does not disturb move of the pushing member and a force of the crane moving in the vertical direction is not transmitted to the power supply truck.

The above-described power supply system is characterized in that the receiving member includes two contact bars each extending in a direction intersecting the travel direction while the pushing member includes a rod protruding from the crane, and the rod is arranged between the two contact bars, and that, when the crane moves in the travel direction, the rod comes into contact with one of the two contact bars to transmit the force in the travel direction, and when the crane moves in the transverse direction, the rod moves in the direction in which the two contact bars extend and does not transmit, to the power supply truck, the force of the crane moving in the transverse direction.

The above-described power supply system characterized in that the receiving member includes a slide bar extending from the power supply truck in the travel direction and the contact bars disposed on the slide bar, and that the pushing member has a portal form by disposing two rods spaced from each other, on a crossbar extending from the crane.

The above-described power supply system is characterized in that power supply equipment of a container terminal and the power supply truck are connected to each other with a power supply belt, and that the power supply belt includes a bendable articulated belt formed by connecting a plurality of tubular bodies, and a power supply cable passing inside the articulated belt.

Incidentally, the power supply truck includes cable reeling and unreeling means for unreeling a cable connected to a power supply connector, a transformer connected to an opposite end of the cable, and a connection part connecting the transformer and the crane. In addition, a cable reel, a power supply belt or the like can be used as the cable reeling and unreeling means.

Effects of the Invention

According to the power supply system for a crane according to the present invention, the linkage mechanism connecting the crane and the power supply truck is configured not to transmit any force of the crane in the transverse direction or the twisting direction to the power supply truck. This configuration can prevent derailment and turnover accidents of the power supply truck. Accordingly, even a power supply truck including no driving system therein can stably follow the crane. Moreover, since the linkage mechanism has a simple configuration ob being formed of a rod or the like, the linkage mechanism is highly durable and can reduce risk of troubles.

Further, linking and unlinking operations of the linkage mechanism for lane change are simplified. This can shorten a time required for lane change.

Further, the configuration of connecting the power supply connector and the transformer with the power supply belt without using a cable reel, can lower the center of gravity of the power supply truck and prevent turnover accidents of the power supply truck. Moreover, the configuration of disposing the power supply cable in the articulated belt can protect the cable from being damaged, or the like.

MODES FOR CARRYING OUT THE INVENTION

Figure 1:
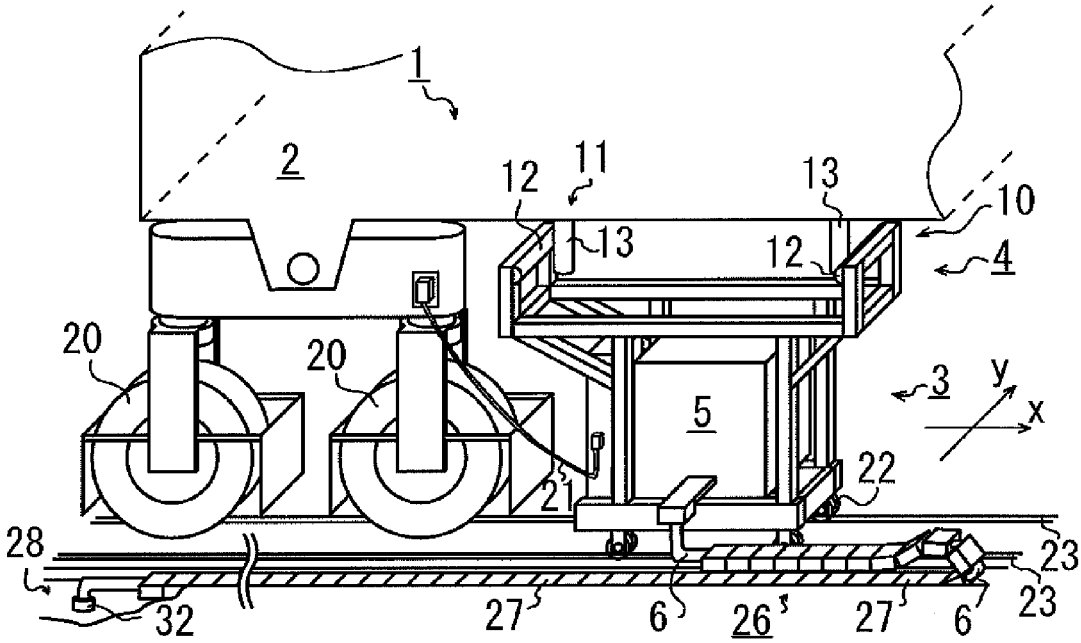
FIG. 1 is a view showing a power supply system for a crane according to an embodiment of the present invention.

A power supply unit for a crane according to an embodiment of the present invention will be described below with reference to the drawings. FIG. 1 shows a crane 2 and a power supply truck 3 included in a power supply system 1. The power supply truck 3 is configured to supply power to the crane 2 through a connection part 21 while traveling by following a travel of the crane 2. A linkage mechanism 4 for the crane 2 and the power supply truck 3 includes a receiving member 10 disposed on the power supply truck 3 and a pushing member 11 disposed on the crane 2.

The receiving member 10 disposed on the power supply truck 3 includes two contact bars 12 each extending in a direction intersecting a travel direction x. Desirably, each of the contact bars 12 is arranged in a direction orthogonal to the travel direction x. The pushing member 11 disposed on the crane 2 includes two rods 13 arranged respectively on inner sides of the two contact bars 12.

Next, operation of the linkage mechanism 4 will be described. The rods 13 move along with a move of the crane 2 in the travel direction x, one of the rods 13 comes into contact with the contact bar 12 that is positioned in the direction in which the rod 13 moves, and then pushes the contact bar 12. A force in the travel direction x thus generated allows the power supply truck 3 to move along rails 23 in the travel direction x.

In addition, if the crane 2 is shifted to a transverse direction y due to occurrence of vibrations or travel deviation, or the like, the rods 13 cannot push the contact bars 12 or the like, for example, of the power supply truck 3 in the transverse direction y. Specifically, since the power supply truck 3 is not provided with any member for preventing movement of the rods 13 in the transverse direction y, no force in the transverse direction y is applied to the power supply truck 3. This configuration prevents occurrence of an accident such as derailment or turnover. Moreover, even if the rods 13 move downward or upward in a vertical direction by deformation of rubber tires supporting the crane due to the weight of a load being lifted, no power in the vertical direction is applied to the power supply truck 3.

Incidentally, the same effects can be produced even when the receiving member 10 and the pushing member 11 of the present invention are disposed respectively on the crane 2 and the power supply truck 3, by contrast to the above. Moreover, unlike a universal joint or the like, this linkage mechanism 4 is characterized in that the crane 2 and the power supply truck 3 are not fixed to each other with a bolt or the like. Further, a single one of the rods 13 in FIG. 1 may be provided.

Next, an installation position of the power supply truck 3 will be described. In FIG. 1, the power supply truck 3 is installed in a space between two pairs of running wheels 20 disposed on foot portions of the crane 2. By employing this installation method, the power supply system 1 shown in FIG. 1 can be applied even in a case of a conventional container terminal having no space for laying the rails 23. Naturally, the power supply truck 3 may have a configuration of following the crane 2 while being disposed beside the running wheels 20 of the crane 2, as in a conventional configuration.

Figure 3:
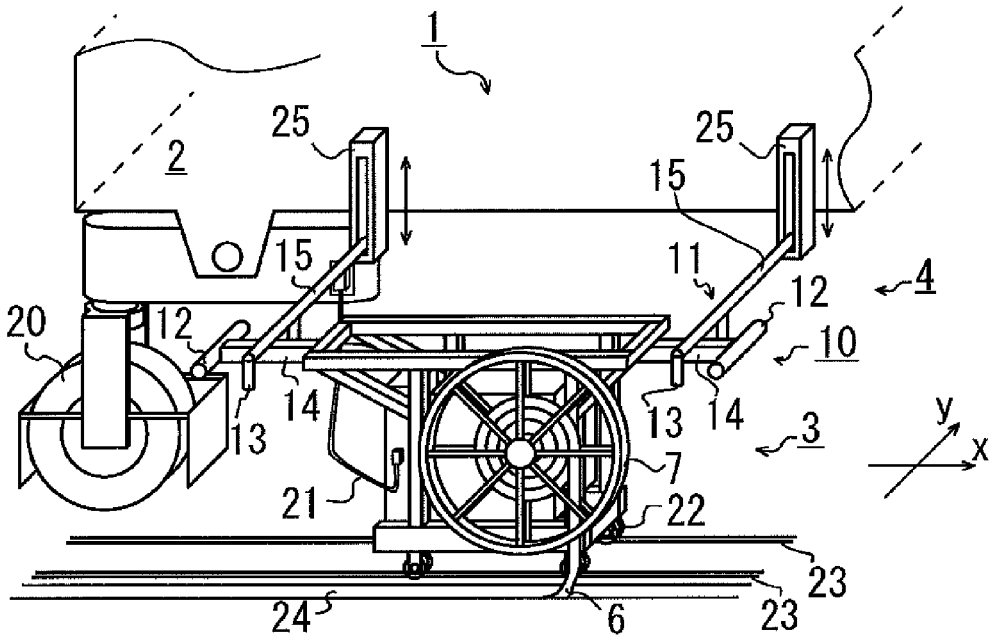
FIG. 3 is a view showing a power supply system for a crane according to a different embodiment of the present invention.

Next, power supply from the container terminal 30 to the power supply truck 3 will be described. As shown in FIG. 3, a cable 6 connected to a power supply connector 32 of the container terminal 30 has a configuration of being unreeled from a cable reel 7 along with movement of the crane 2. In an alternative configuration, a power supply belt 26 may be provided instead of the cable reel 7, as shown in FIG. 1.

The power supply belt 26 includes a bendable articulated belt 27 formed by connecting multiple tubular bodies, and the cable 6 inserted into a space inside the articulated belt 27. The cable 6 is protected by the articulated belt 27, which is a frame.

The power supply belt 26 connects the power supply connector 32 and the transformer 5 to each other, and is towed by the crane 2 while shifting a position at which the power supply belt 26 is bent, along with travel of the crane 2. Specifically, while the crane 2 is located close to the power supply connector 32, the power supply belt 26 is folded. When the crane 2 starts to travel, an upper side of the folded power supply belt 26 slides, and comes to serve as a bent portion and then to be located on a lower side. In this event, a portion, initially located on the lower side, of the power supply belt 26 does not move. When the crane 2 arrives at an opposite end of the lane 31, the power supply belt 26, which used to be folded, is totally unfolded. This configuration of using the power supply belt 26 instead of the cable reel 7 lowers the center of gravity of the power supply truck 3, and can consequently further reduce occurrence of turnover accidents of the power supply truck 3.

Here, the power supply belt 26 is housed in a belt groove 28 not to disturb travel of the trailers 33 and the like moving in the container terminal 30. In addition, arranging the power supply connector 32 in a center portion of the lane 31 allows the power supply belt 26 to be half as long as the entire length of the lane 31 at maximum. This configuration can reduce the cost.

Moreover, with the configuration of the linkage mechanism 4 shown in FIG. 1, only the connection part 21, which connects the crane 2 and the power supply truck 3 to each other and in which low voltage current flows, needs to be subjected to a linking or unlinking operation when the crane 2 is to be moved to a different lane 31 (change lanes). This configuration simplifies the operation for lane change, and hence lane change can be completed in a short period of time.

Figure 2:
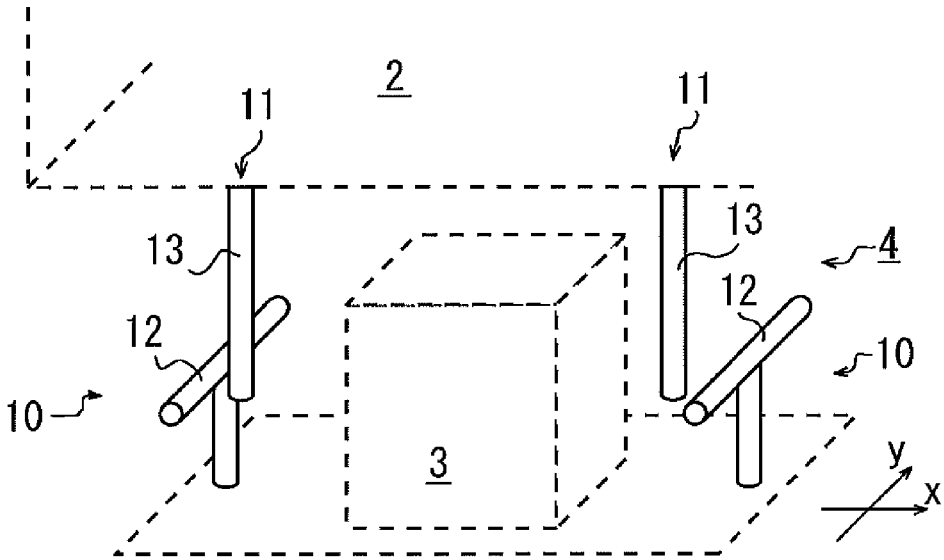
FIG. 2 is a view showing a linkage mechanism of the power supply system.

FIG. 2 shows a linkage mechanism 4 according to a different embodiment of the present invention. Receiving members 10 disposed on a power supply truck 3 each have a configuration of being a substantially T-shaped member and having a contact bar 12 to serve as an upper portion of the member. Each of the contact bars 12 extends in a direction intersecting a travel direction x. Meanwhile, pushing members 11 disposed on a crane 2 are arranged respectively on inner sides of the contact bars 12 and are formed respectively of two rods 13.

FIG. 3 shows a power supply system 1 according to a different embodiment of the present invention. Receiving members 10 disposed on a power supply truck 3 each include a slide bar 14 extending from the power supply truck 3 in a travel direction x, and contact bars 12 disposed respectively at end portions of the slide bar 14. Meanwhile, pushing members 11 each have a portal form by including a crossbar 15 extending from a crane 2 and two rods 13 disposed on the crossbar 15 to be spaced from each other. While a linkage mechanism 4 is connected, a concave portion of each of the portal pushing members 11 is slidable along a corresponding one of the slide bars 14. When one of the pushing member 11 arrives at an end portion of a corresponding one of the slide bars 14, the rods 13 come into contact with the contact bar 12 to transmit a force in the travel direction x.

In addition, the two rods 13 are arranged on each of the crossbars 15 while being spaced from each other at an amount equal to or larger than travel deviation of the crane 2. With this configuration, even if the crane 2 is shifted to a transverse direction y, the rods 13 do not come into contact with the slide bars 14.

Further, each of the pushing members 11 is disposed on the crane 2 through a lifting unit 25 capable of moving the portal pushing member 11 in vertical directions as shown by an arrow in FIG. 3. The lifting units 25 are used to unlink the crane 2 and the power supply truck 3. Here, a raising unit, instead of the lifting unit 25, may be used which raises the portal pushing member 11 by using a root portion of the portal pushing member 11 as the center.

It should be noted that, although the effects of the present invention can be sufficiently brought about even with the power supply truck 3 having a cable reel 7 as shown in FIG. 3, the effects can be stronger in a case of using the above-described power supply belt 26. Incidentally, the cable 6 is housed in a cable groove 24 as the power supply 26 is.

Figure 4:
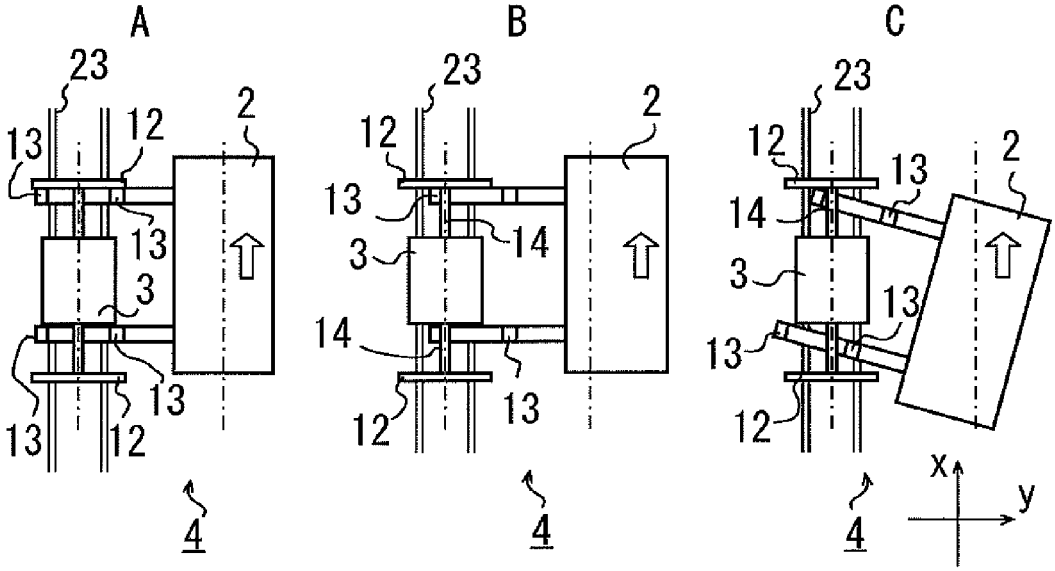
FIG. 4 includes views each showing a state of a linkage mechanism when a crane is in operation.

FIG. 4 shows operations of a linkage mechanism 4 when a force in a transverse direction y or a twisting direction is applied to a crane 2. Here, the linkage mechanism 4 shown in FIG. 4 has a configuration slightly different from that shown in FIG. 3 in terms of pushing members 11. Specifically, each of the pushing members 11 is formed to have a concave portion facing upward by including two rods 13 on an upper side of a crossbar 15. For this reason, a lifting unit 25 is also configured to move the portal pushing member 11 downward in a vertical direction in changing lanes.

FIG. 4A shows a state in which a power supply truck 3 travels by following the crane 2 moving in a travel direction x, i.e. upward in the drawing. In this state, a contact bar 12 locating on an upper side in the drawing is in contact with the two rods 13 locating on the upper side in the drawing.

FIG. 4B shows a case in which the crane 2 is shifted to the transverse direction y, and shows a state in which the power supply truck 3 receives a force in the travel direction x while not receiving any force in the transverse direction y. Specifically, the contact state of the contact bar 12 and the rods 13 is maintained while slide bars 14 are not in contact with the rods 13. Accordingly, only the force in the travel direction x is applied to the power supply truck 3 by the crane 2. Here, the space between the two rods 13 is determined to allow shift of the crane 2 in the transverse direction y.

FIG. 4C shows a case in which the crane 2 is shifted in the twisting direction, and shows a state in which the power supply truck 3 receives a force in the travel direction x while not receiving any force in the transverse direction y as in the above-described case. Here, the space between the two rods 13 and the length of each of the slide bars 14 are determined to allow shift of the crane 2 in the twisting direction.

Figure 5:
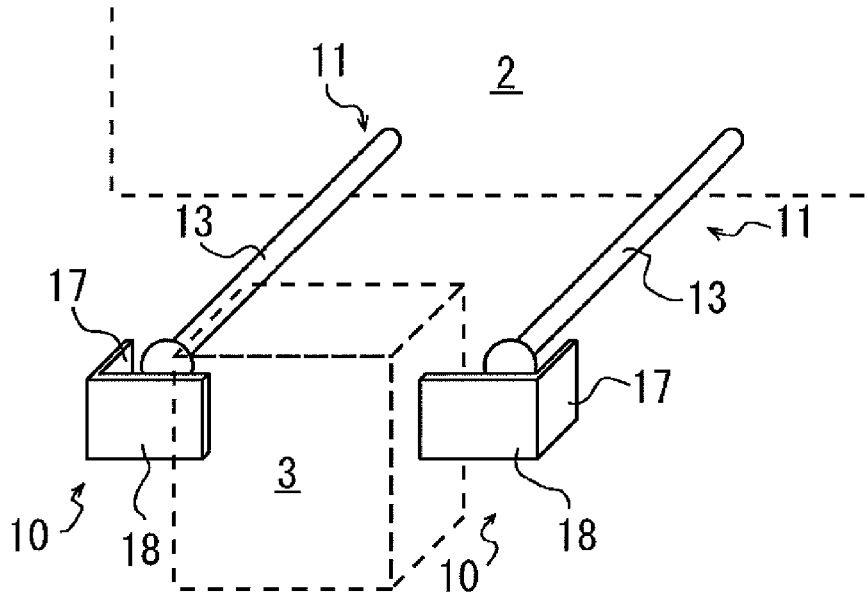
FIG. 5 is a view showing a power supply system for a crane according to a different embodiment of the present invention.
Figure 6:
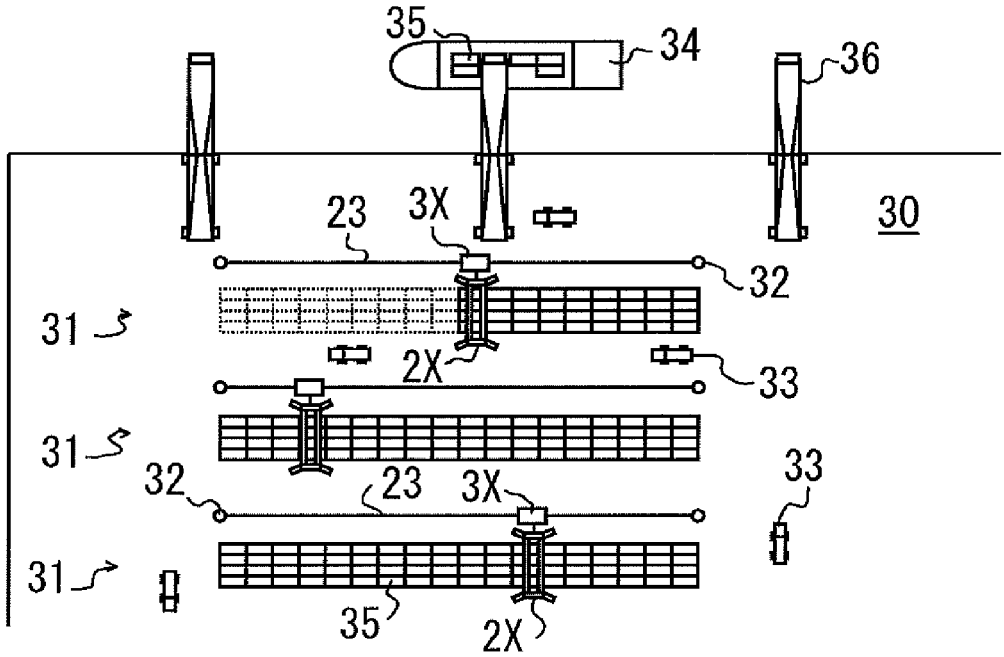
FIG. 6 is a schematic view showing a container terminal.
Figure 7:
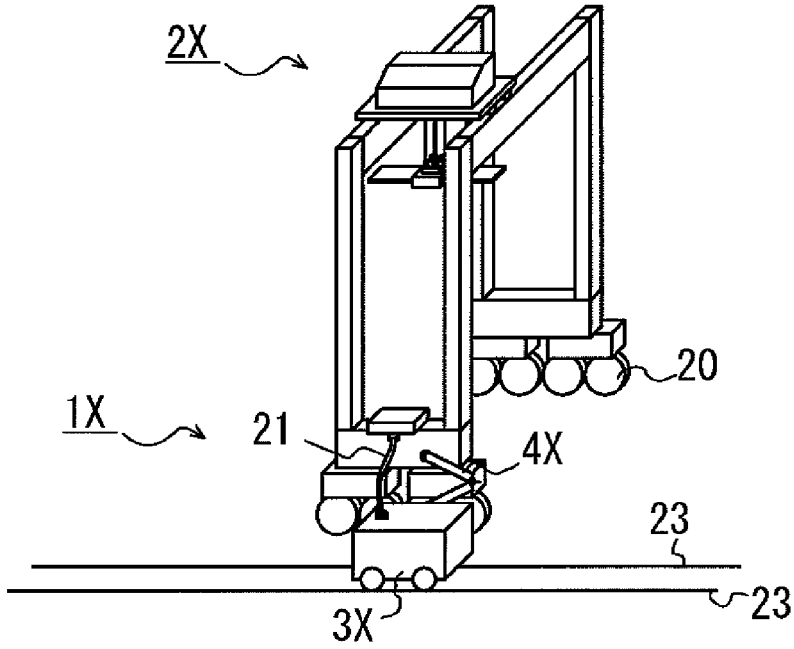
FIG. 7 is a view showing a conventional power supply truck and crane.
Figure 8:
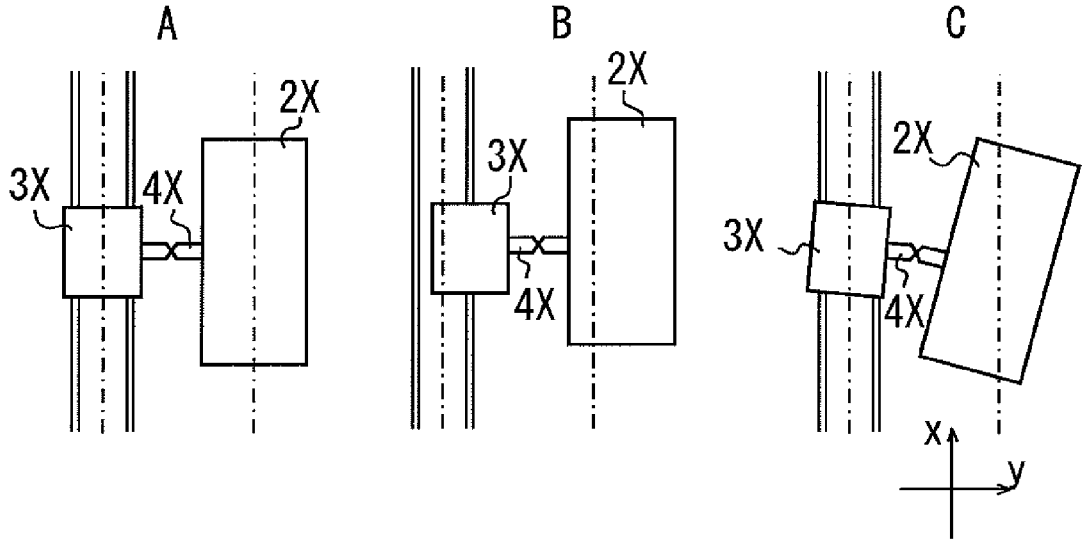
FIG. 8 includes views each showing travel deviation occurring in the crane.

FIG. 5 shows a linkage mechanism 4 according to a different embodiment of the present invention. Receiving members 10 disposed on a power supply truck 3 each include a contact wall 17 corresponding to a contact bar 12 and a slide wall 18 corresponding to a slide bar 14. Meanwhile, pushing members 11 disposed on a crane 2 are arranged respectively on inner sides of the contact walls 17, and are formed respectively of two rods 13. It should be noted that each of the slide walls 18 needs to be arranged in a position not to disturb move of the rod 13 in a transverse direction y. For example, the slide wall 18 may be arranged so that the rod 13 passes under the slide wall 18 while using the slide wall 18 as a ceiling position.

EXPLANATION OF REFERENCE NUMERALS

1 power supply system
2 crane
3 power supply truck
4 linkage mechanism
5 transformer
6 cable
7 cable reel
10 receiving member
11 pushing member
12 contact bar
13 rod
14 slide bar
15 crossbar
26 power supply belt
27 articulated belt
32 power supply connector

What is claimed is:

1. A power supply system for a crane in which a crane for loading and unloading a container for marine transportation is linked to a power supply truck for supplying power while following the crane, with a linkage mechanism, the power supply system characterized in that the linkage mechanism includes:

a receiving member disposed on the power supply truck; and a pushing member disposed on the crane, and the power supply system includes the linkage mechanism configured in a manner that, when the crane moves in a travel direction, the pushing member comes into contact with the receiving member to transmit a force of the crane moving in the travel direction to the power supply truck, when the crane moves in a transverse direction intersecting the travel direction, the receiving member does not disturb move of the pushing member, and thus a force of the crane moving in the transverse direction is not transmitted to the power supply truck, and when the crane is displaced in a vertical direction, the receiving member does not disturb move of the pushing member, and thus a force of the crane moving in the vertical direction is not transmitted to the power supply truck.

2. The power supply system according to claim 1, wherein the receiving member includes two contact bars each extending in a direction intersecting the travel direction while the pushing member includes a rod protruding from the crane, and the rod is arranged between the two contact bars, when the crane moves in the travel direction, the rod comes into contact with one of the two contact bars to transmit the force in the travel direction, and when the crane moves in the transverse direction, the rod moves in the direction in which the two contact bars extend, and does not transmit, to the power supply truck, the force of the crane moving in the transverse direction.

3. The power supply system according to claim 2, wherein the receiving member includes: a slide bar extending from the power supply truck in the travel direction; and the contact bars are disposed on the slide bar, and the pushing member has a portal form in which two rods spaced from each other are disposed on a crossbar extending from the crane.

4. The power supply system according to any one of claim 2, further comprising a power supply belt connecting power supply equipment of a container terminal and the power supply truck to each other, wherein the power supply belt includes:

a bendable articulated belt formed of a plurality of tubular bodies connected together; and a power supply cable passing inside the articulated belt.

5. The power supply system according to claim 1, wherein power supply equipment of a container terminal and the power supply truck are connected to each other with a power supply belt, and the power supply belt includes:

a bendable articulated belt formed by connecting a plurality of tubular bodies; and a power supply cable passing inside the articulated belt.

* * * * *